US005878519A

United States Patent [19]

Huyck, Jr. et al.

[11] Patent Number: 5,878,519

[45] Date of Patent: Mar. 9, 1999

[54] SIGN SUPPORT APPARATUS

[75] Inventors: David M. Huyck, Jr., Peoria; Gregory K. Hoffman, Goodyear, both of Ariz.

[73] Assignee: Woudenberg Enterprises, Inc., Phoenix, Ariz.

[21] Appl. No.: 876,307

[22] Filed: Jun. 16, 1997

[51] Int. Cl.[6] ..... G09F 15/00

[52] U.S. Cl. ..... 40/612; 40/608; 40/607; 248/214; 248/231.71

[58] Field of Search ..... 40/606, 607, 608, 40/612; 248/214, 228, 231.71; 403/13, 229

[56] References Cited

U.S. PATENT DOCUMENTS

| | | | |
|---|---|---|---|
| 2,025,004 | 12/1935 | Shearer | 40/607 |
| 2,614,471 | 10/1952 | Markowitz | 248/214 X |
| 2,655,748 | 10/1953 | Hirt . | |
| 3,021,601 | 2/1962 | Hayes | 248/214 X |
| 3,593,418 | 7/1971 | Evans . | |
| 3,664,626 | 5/1972 | Sneller | 248/214 X |
| 4,059,248 | 11/1977 | Kuntz . | |
| 4,301,767 | 11/1981 | Willinger et al. | 248/214 X |
| 4,544,125 | 10/1985 | Seely | 40/608 X |
| 4,709,891 | 12/1987 | Barnett | 248/231.71 X |
| 5,014,948 | 5/1991 | Asaro et al. . | |
| 5,037,051 | 8/1991 | Moriello . | |
| 5,208,585 | 5/1993 | Sprague . | |
| 5,377,945 | 1/1995 | Steinke | 40/608 X |
| 5,395,080 | 3/1995 | Smith . | |
| 5,531,540 | 7/1996 | Wasserstrom et al. . | |

*Primary Examiner*—Brian K. Green
*Assistant Examiner*—Robert G. Santos
*Attorney, Agent, or Firm*—Gregory J. Nelson

[57] ABSTRACT

A support and gripping apparatus for supporting traffic control signs to a concrete roadway abutment. The support has a plate which rests on the top of the abutment and which is held in place by a flange and adjustable grips which engage the abutment side wall. C-clamps are positioned along the plate. An adaptor is detachably securable to the plate and has a spring and vertically extending tube which carries the sign. Handles may be provided on the base to assist in moving and positioning the support. The adaptor may extend horizontally in cantilever fashion past the abutment side wall and having a group supported leg for additional stability. A wedge may be used by the installer to lift a glare screen if one is mounted on the abutment.

14 Claims, 3 Drawing Sheets

SIGN SUPPORT APPARATUS

The present invention relates to a support apparatus and more particularly relates to a support and gripping apparatus for securing a traffic control sign to a base member such as a concrete abutment.

BACKGROUND OF THE INVENTION

Temporary concrete abutments are used to mark and delineate vehicle traffic lanes. Concrete abutments of this type are commonly used in road construction areas to define temporary roadway or vehicle lanes. Because of space restrictions in construction areas, use of conventional roadside traffic control signs is not often practical. Accordingly, a problem arises as to the placement of traffic control signs such as signs advising motorists of legal speed limits, narrowing lanes, lane restrictions, curves, no stopping areas and the like. Accordingly, it has become a common practice to position traffic control signs on the top of concrete abutments which align the roadway. Traffic control signs are customarily clamped to the top of abutments using conventional clamping devices. However, conventional clamps such as C-clamps and the like do not provide adequate retention and gripping force, particularly when signs are located in close proximity to traffic lanes where passing vehicles, particularly, large trucks exert considerable vacuum or draft forces against the surface of the sign which may cause it to become loosened or to become dislodged from the abutment. Obviously, dislodgement of a traffic control sign poses an immediate and hazardous condition to both traffic and personnel in the area.

SUMMARY OF THE INVENTION

Briefly, the present invention relates to a support or retention device which mounts to the abutment securing traffic control members such as traffic signs to the top of the concrete abutment. Traffic abutments of this type are generally preformed temporarily positioned along the roadway such as through construction areas. The top surface of the abutment is planar and may be of varying width. Abutments may diverge outwardly toward a base.

The device of the present invention has a base plate which is elongated having a depending flange along one edge. The base plate is adapted to rest on the upper surface of the abutment with the flange engaging a vertical side wall of the abutment. One or more adjustable slider or gripping clamps mounted on the base can be adjusted to grip the vertical side of the abutment opposite the flange. C-clamps are secured to the base by a flexible chain or cable and at the time of installation are positioned with the body of the clamp engaging the base and with the opposite jaws of the clamps engaging the opposite vertical walls of the abutment to restrain the base plate against both lateral and lifting movement. Handles may also be provided extending from the base to facilitate lifting the device when transporting, installing and removing the apparatus.

Traffic control signs for temporary installation will generally include a panel portion which may be of various shapes and which carries an appropriate legend or graphic. The sign is mounted on a shaft which is attached to a spring at its lower end. The lower end of the spring is secured to an adaptor which has a pair of oppositely extending flanges. The adaptor is releasably retained on the base. One flange of the adaptor is received within a slot or groove and a hold down releasable engages the opposite flange. The adaptor may also include a leg which extends downwardly and has fixed or adjustable stops that engages the vertical side-wall of the abutment to stabilize the support.

In another embodiment of the invention, the adaptor is elongated and extends laterally from the vertical side-wall of the abutment. A stand has a ground engaging pad and an upright tubular member which may be selectively secured to the adaptor by spring loaded detent pin or other retainer member.

The invention also comprehends a tool which may be used to assist the installer in positioning the apparatus on the upper surface of an abutment in installations where the abutment supports a vertical anti-glare screen. The installation tool is a wedge-type device which may be inserted to lift the lower edge of the screen to accommodate the placement of the support apparatus.

BRIEF DESCRIPTION OF THE DRAWINGS

The above and other objects and advantages of the present invention will be more fully appreciated from the following description, claims and the drawings in which;

DETAILED DESCRIPTION OF THE INVENTION

Figure 1:
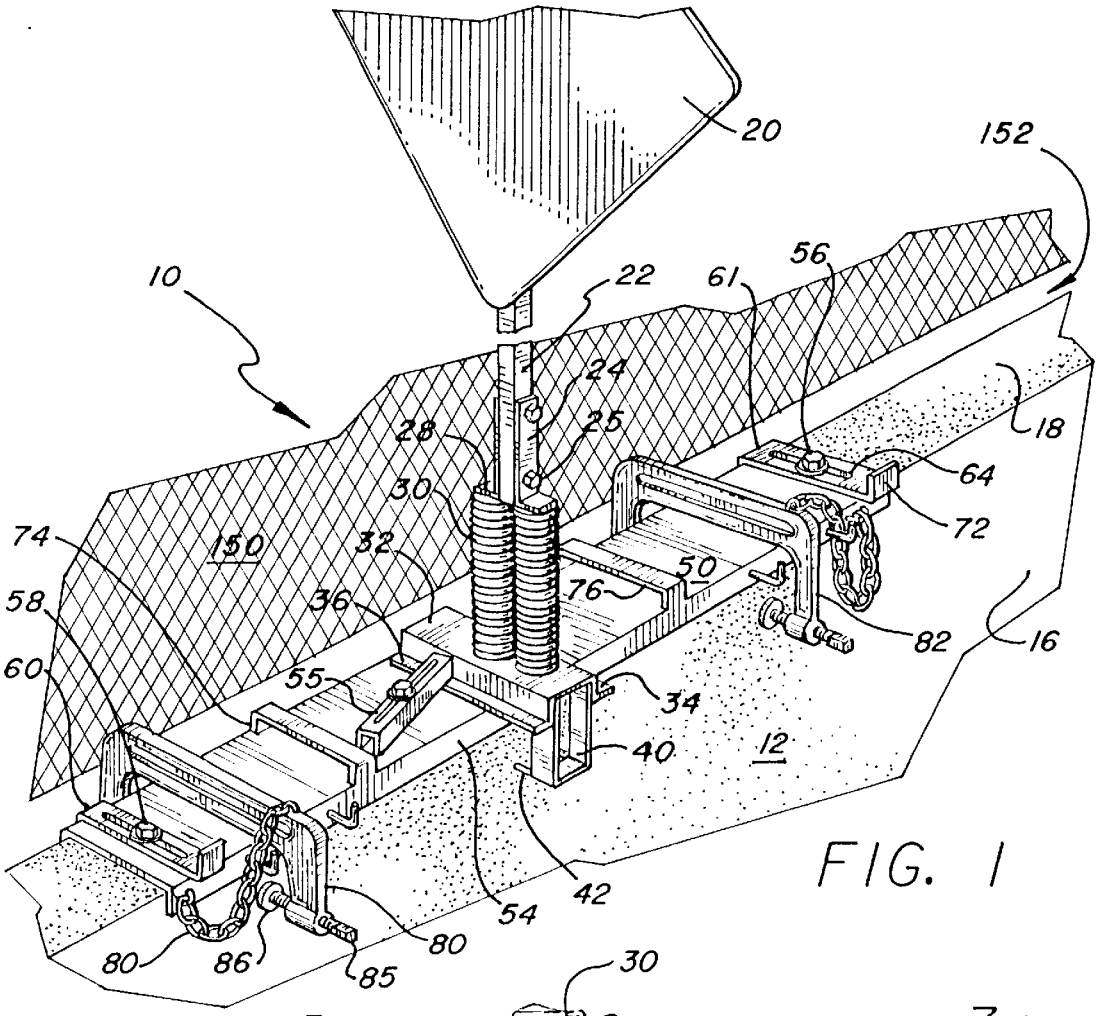
FIG. 1 is a perspective view of the support apparatus of the present invention shown installed on a traffic abutment.

Referring now to the drawings, particularly FIGS. 1–8, the support apparatus of the present invention is generally designated by the numeral 10. As indicated above, the support 10 is intended for installation on structures such as concrete abutment 12. Concrete abutments 12 are generally provided sections and are temporarily positioned in medians and along traffic lanes. Abutments of this type are constructed of concrete having opposite side-walls 14 and 16 and are generally flat or planar upper surface 18. Side-walls 14 and 16 may flare or extend outwardly toward a base, not shown, which rests on the ground surface.

The support 10 is intended to support a traffic control sign such as sign 20. Sign 20 may be in any shape or square, rectangular, round carrying information for motorists such as speed limits, cautionary notices and other conventional signs. The sign 20 is supported on a tube 22 which at its lower end is secured to a pair of oppositely positioned and generally L-shaped brackets 24 by fasteners 25. The horizontal legs 28 of the L-shaped brackets are secured to a spring 30. The lower end of each of the springs is secured by a fastener 33 to adaptor 32. The springs 30 provide a resilient mounting so that impact or wind forces, either natural or imparted due to draft created by passing traffic, will cause the springs to deflect absorbing energy preventing damage to the sign. Rigid retention of signage would be unsatisfactory as the sign or its mounting tube would tend to fail over a period of prolonged use. Also, the resilient mounting of the sign 20 is safer in the event of impact with a vehicle.

Figure 2:
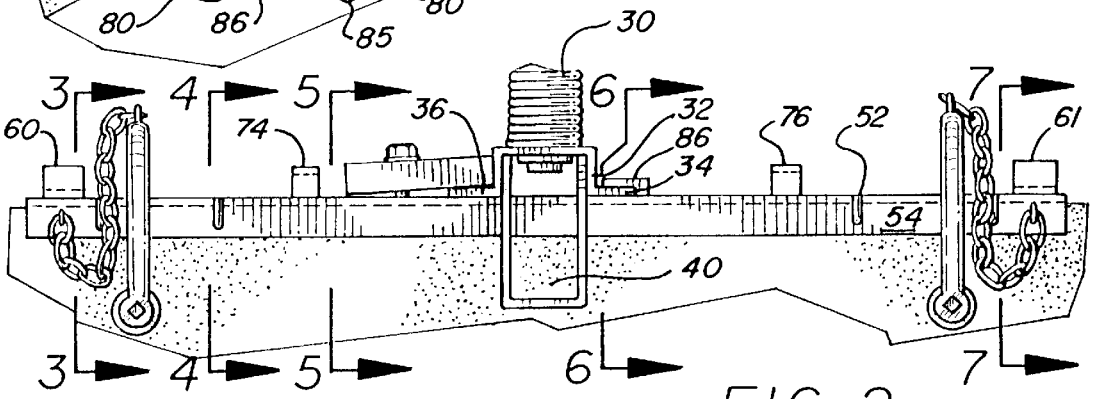
FIG. 2 is a side view of the retention apparatus shown in FIG. 1.

The adaptor 32 is in the form of an inverted C-shaped channel having an overall length approximately, corresponding to the width of the abutment. The adaptor 32 has a pair of oppositely extending flanges 34 and 36 which, in the installed position, rest on the upper surface of the abutment as seen in FIGS. 1 and 2. One end of the adaptor may carry a depending leg member 40 which may have one or more inwardly disposed stop members 42 which may be either fixed as shown in FIG. 1 or adjustable as described hereafter with respect to FIGS. 9 and 10.

The support includes a base plate 50 which has a planar upper surface 52. A flange 54 extends downwardly along one edge of the plate. A pair of studs 56 and 58 are welded to the upper surface 52 of the plate adjacent the ends and the studs project upwardly. Each of the studs carries adjustable gripping means in the form of sliders 60, 61 each of which have a flat strap portion 62 extending transversely across the base. A slot 64 is provided each of the sliders and receives the associated upstanding stud.

Figure 7:
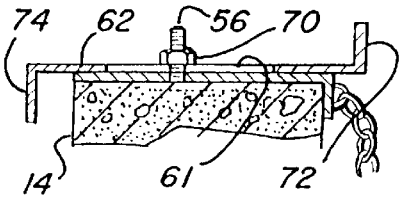
FIG. 7 is a sectional view taken along line 7—7 of FIG. 2.

As seen in FIG. 7, nut 70 may be loosened to provide for lateral adjustment of the slider and tightened once the appropriate adjustment is made. One end of the slider has an upwardly extending flange 72 and the opposite end of the strap has a downwardly depending flange 74. The flange 72 provides a gripping surface for the installer when installing the device and flange 74 engages a side wall of the abutment when tightened.

Figure 4:
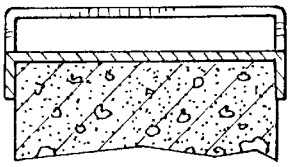
FIG. 4 is a sectional view taken along line 4—4 of FIG. 2.
Figure 5:
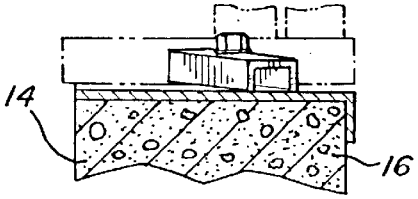
FIG. 5 is a sectional view taken along line 5—5 of FIG. 2.
Figure 6:
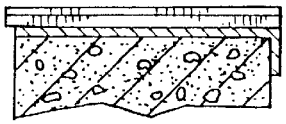
FIG. 6 is a sectional view taken along line 6—6 of FIG. 2.

A pair of U-shaped handles 75 and 76 are welded or otherwise secured to the base at spaced-apart locations convenient for the installer to grasp when lifting or transporting the device. These are seen in FIGS. 1 and 4.

Figure 3:
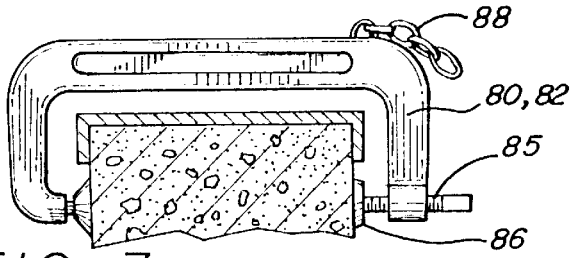
FIG. 3 is a sectional view taken along line 3—3 of FIG. 2.

Clamps, 80 and 82, which are shown as C-clamps are also provided to secure and hold down the device against dislodgement. The C-clamps are shown as conventional C-clamps having an elongated body with each having an adjustment screw 85 which may be extended or retracted to bring the jaws 87 into engagement with the abutment. Each of the C-clamps 80 and 82 is permanently secured near the ends of the base by a flexible cable or chain 88 to prevent theft and to maintain the clamps with the base. A pair of eyelets 89 project from each clamp as best seen in FIG. 3.

A pair of hooks 90 and 91 are provided extending from the flange of the base at spaced-apart locations so that the C-clamps may be suspended from the hooks at eyelets 89 when the device is stored or being transported to or from a use location.

In use, the support 10 is positioned on the upper surface 18 of the abutment wall. The installer may conveniently lift the device from the bed of a truck by grasping the handles 74 and 76 and manually transporting the device to the installation location. During the manual transportation of the device, the C-clamps 80, 82 will normally be supported in a suspended position on hooks 90 and 91. Once the support is in position on the wall, it is manually moved to a position so that the lip or flange 54 tightly abuts the vertical edge of the abutment adjacent to the installer. The nuts 60 or studs 58, 60 may be loosened and the sliders 60, 61 can be moved to position the associated depending flange 74 engaging the opposite vertical surface 14 of the abutment. The nuts 70 then are tightened so that the support is secured against lateral movement. Vertical movement is resisted by securing the C-clamps 80 and 82 in the position shown in FIGS. 1 and 3 and the installer tightens screws 85 associated with each of the clamps. Note the clamps are tethered to the support by chain or cable 81 so that they cannot become separated.

Figure 8:
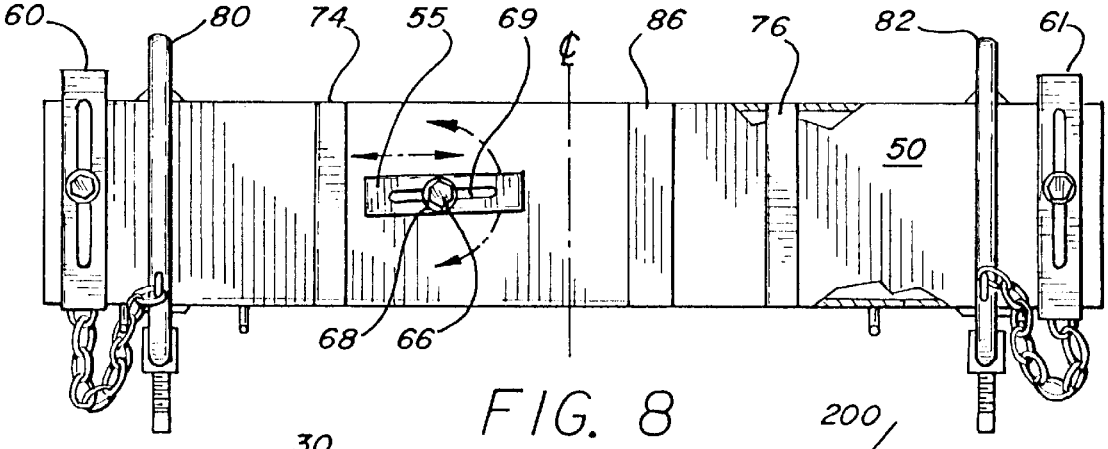
FIG. 8 is a plan view of the support apparatus.

The sign 20 is then positioned on the support by inserting flange 34 of the adaptor beneath the L-shaped lip 86. The opposite flange 36 of the adaptor is secured by a hold down 55. Hold down 55 is an elongated member having a C-shaped cross section and is positioned by adjusting it relative to stud 66 at nut 68 along slot 69 as seen in FIG. 8. The lip 86 and the hold down provide a receiver for detachably securing the adaptor to the upper surface of the support 10.

In the installed position, the sign is supported on the upper surface of the abutment in a stable position by the support. Lateral displacement of the sign and support is resisted by the base and the sliders at the opposite end of the base. Transverse movement along the upper surface of the abutment is resisted by the C-clamps although some limited movement may be allowed to assist in dissipating energy.

The forces imposed against the sign 20 are absorbed by the springs 30 and will also be absorbed by the base and the abutment as both lateral and longitudinal forces will be transferred to the abutment through the support.

Figure 9:
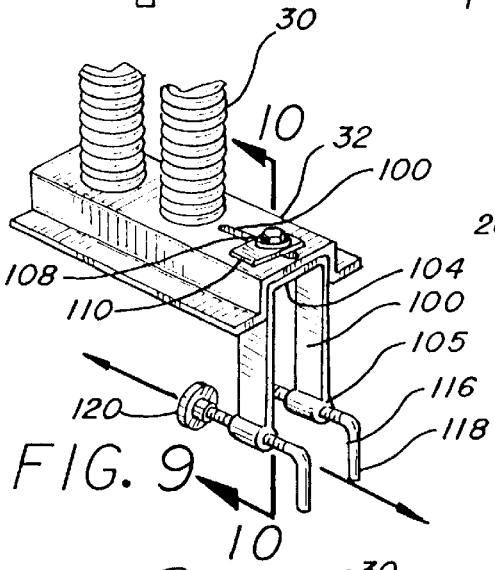
FIG. 9 is a perspective view of a alternate embodiment of the adaptor component of the retention device.
Figure 10:
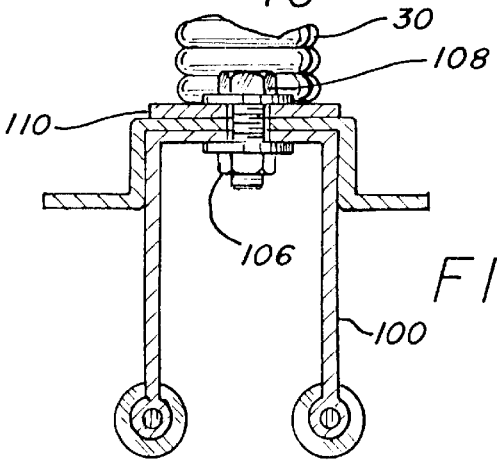
FIG. 10 is a sectional view taken along lines 10—10 of FIG. 9.

FIGS. 9 and 10 show an alternate embodiment of the present invention in which the adaptor is provided with adjustability on the depending legs. The adaptor 32 as been described above and supports springs 30 which are secured to the tubular support posts of the sign. The generally U-shaped depending leg member 100 may be laterally adjusted along the adaptor at slot 102. The upper or bight section 104 of leg member 100 has an upstanding stud 106 which receives nut 108 which will clamp retaining plate 110 tightly against the adaptor. The lower ends of legs 100 member have internally threaded ends 115 which each receive a screw 116 which may be extended or retracted by means of rotation of handle 118. The other end of the screw carries a bearing member 120 which may be brought into engagement with the abutment wall.

In some installations it is necessary to install anti-glare screen along the upper surface of the abutment as shown in FIG. 1. The glare screen 150 reduces the glare of headlights from the oncoming traffic lane. Often the glare screen is positioned so that minimal space 152 exists below the lower edges of glare screen and the upper surface of the abutment.

Figure 11:
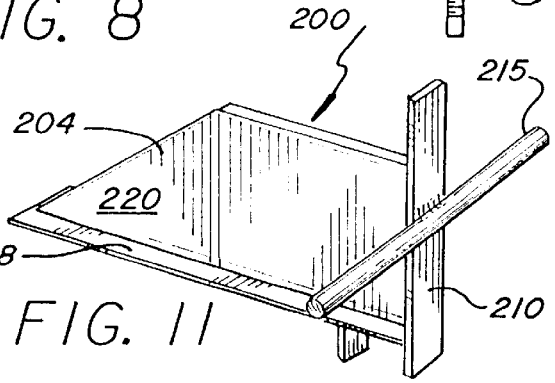
FIG. 11 is a perspective view of the installation tool which may be used to assist in the installation of the support of the present invention.
Figure 12:
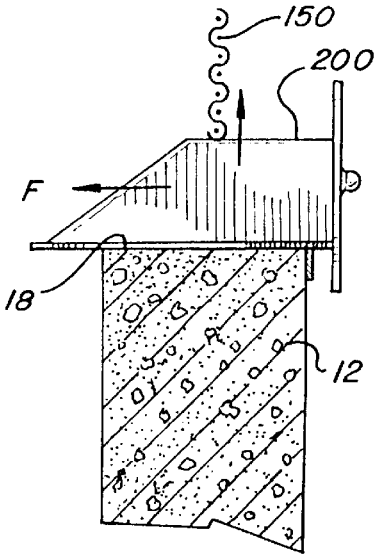
FIG. 12 is a end view showing the use of the installation tool in FIG. 11.
Figure 13:
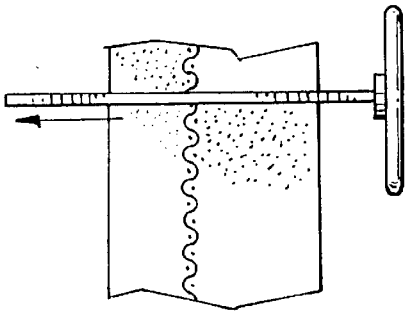
FIG. 13 is a top view showing use of the installation tool in FIG. 11.

Accordingly, it is helpful in installing the support apparatus in this situation to have the assistance of tool 200 as shown in FIGS. 11, 12 and 13. The tool 200 has a blade 220 with a wedge shaped or inclined forward edge 204. The bottom edge of the blade 220 carries a transversely extending flat base 208. The rear edge of the plate carries a strap 210 which extends beyond the upper and lower edges of the blade. A handle 215 extends transversely across the blade 210 and is welded to the staple.

The tool 200 assists in lifting or compressing the glare screen 150 to provide clearance so that the support device may be more easily installed. As shown in FIGS. 12 and 13, the wedge like tool may be inserted by engaging the flat base 208 with the upper surface 18 of the abutment and manually forcing the tool forwardly in the direction F as seen in FIG. 12. This movement will cause the bottom edge of the screen 130 to ride up the inclined surface 204 lifting the bottom edge of the screen well above the surface 18 of the abutment. The tool is left in place providing clearance so the support may be installed. Once installed, the tool 200 is removed.

Figure 14:
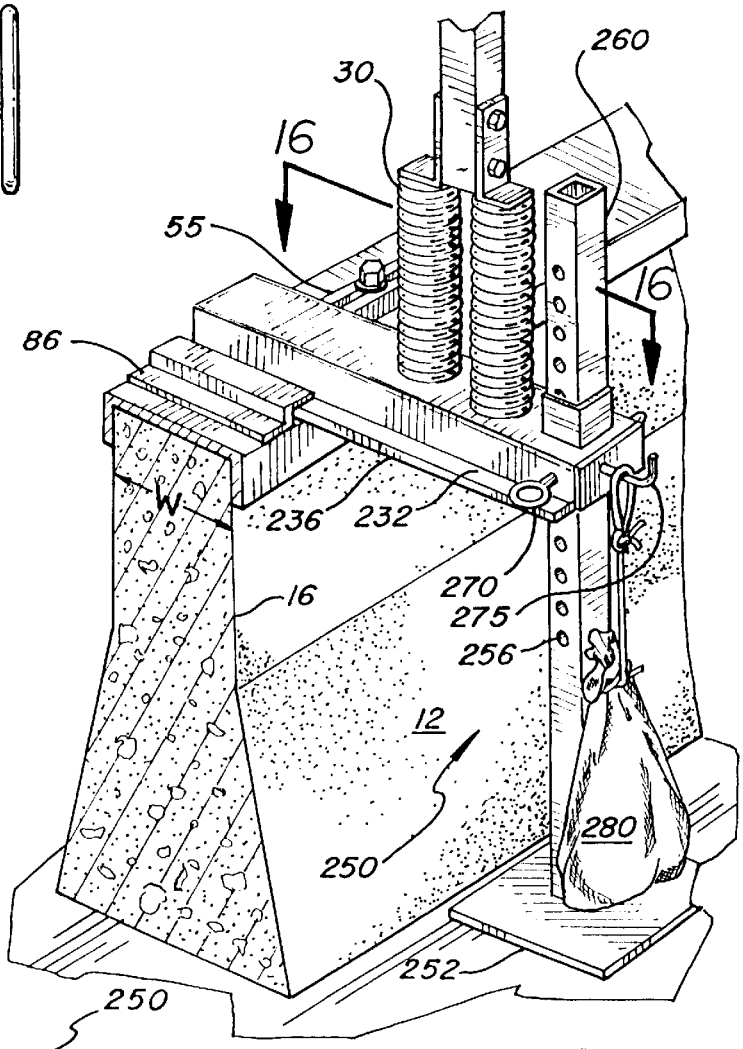
FIG. 14 is a perspective view showing an alternate embodiment of the apparatus of the present invention which includes a supporting leg.
Figure 15:
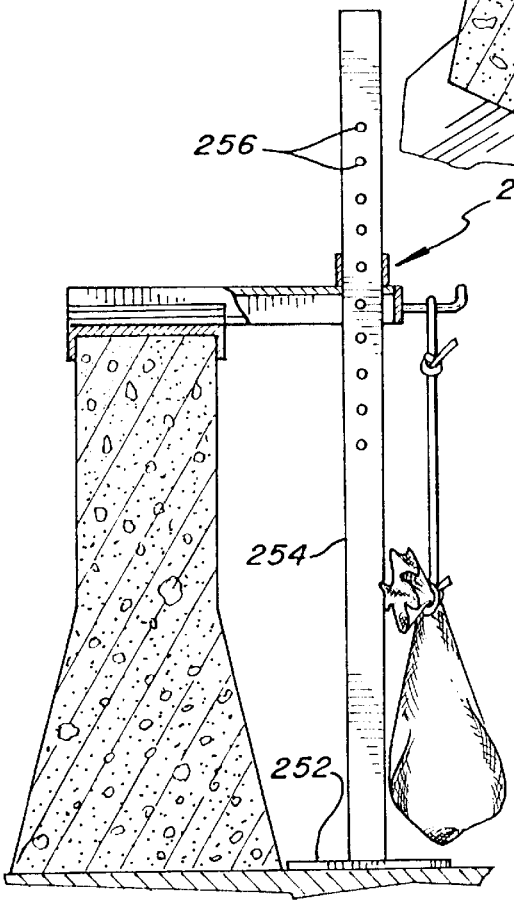
FIG. 15 is a side view of the embodiment of FIG. 14.
Figure 16:
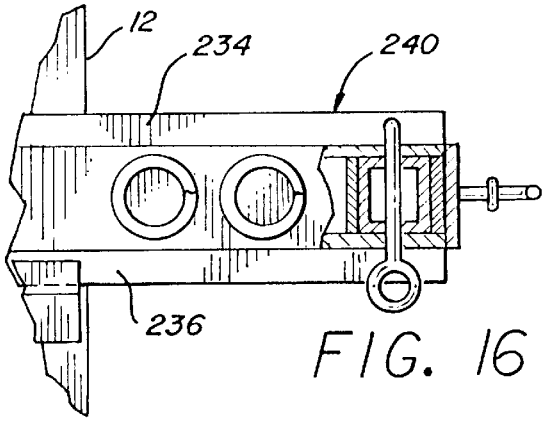
FIG. 16 is a sectional view taken along lines 16—16 of FIG. 14.

Another embodiment of the invention shown in FIGS. 14 through 16. In this embodiment, the support base plate 50 is substantially as has been described above is secured in place by adjustable sliders and C-clamps in the manner described above. A lip 86 defines a transverse slot and an adjustable hold down member 55 is positioned opposite the lip.

The adaptor 232 is similar to the adaptor 32 having an inverted body and opposite extending flanges 234, 236. Adaptor 232 has a length greater than the width of the abutment 12. The width of the abutment is represented by the letter W in FIG. 14. Sign supporting springs 30 are secured to the adaptor 232 at a location outward of the vertical wall 16. This allows the supported sign to be displayed or positioned adjacent to the rear side of the abutment 12. However, since mounting in this fashion creates a substantial overhanging or cantilever load, a stand 250 is provided to assist in supporting the sign. The stand 250 has a ground engaging base plate 252 and an upstanding tubular member 254. The tubular member 254 defines a plurality of spaced-apart holes 256. A tubular receiver 260 is secured at the outer end of the adaptor 240. The receiver 260 slidingly receives the tubular member 254. The adaptor and the stand can be secured at a desired position by registering one of the selected holes 256 with spring loaded retainer member 270 which is located on the outer end of the adaptor.

Hook 275 is secured to the outer end of the adaptor and provides a location at which one or more weights such as sandbags 280 may be secured to provide additional stability.

It will be seen from the foregoing that the present invention provides a simple yet highly effective mounting support for traffic control signage and the like. The support has the advantage that it can easily be installed or removed by workers having no special training or skill. The device may be manually transported or positioned by use of the integrally formed handles. The device is one piece construction so that there are not loose components that can become lost or subject to theft. The relatively large base surface provides security and stability for safety of both workers in the area and passing motorists. No special tools are needed for installation or removal of the device and installation can be accomplished by use of a single wrench for tightening the nuts and tightening and loosening the C-clamps.

While the principles of the invention have been made clear in the illustrative embodiments set forth above, it will be obvious to those skilled in the art to make various modifications to the structure, arrangement, proportion, elements, materials and components used in the practice of the invention. To the extent that these various modifications do not depart from the spirit and scope of the appended claims, they are intended to be encompassed therein.

We claim:

1. A support apparatus securable to an abutment having a generally planar top and opposite side walls, said support apparatus comprising:

(a) a base plate having a top and bottom surface and opposite first and second edges, and opposite first and second ends, said base plate being generally elongated for resting on said planar top;

(b) a first flange depending from said first edge of said base plate;

(c) slider means adjustably secured to said base plate and having a second flange depending at said second edge of said base plate, said slider means being transversely adjustable for securing said base plate to said abutment with said first flange engaging one side wall and said second flange engaging the other side wall;

(d) receiver means on the top surface of said base plate at an intermediate location;

(e) an adaptor detachably securable at said receiver means having support means thereon;

(f) said support means on said adaptor including an upstanding tube for supporting a sign at its upper end and resilient means for resisting applied forces; and (g) wherein said receiver means comprises a lip defining a slot and adjustable hold down means and wherein said adaptor has opposing flanges respectively engageable in said slot and by said hold down means.

2. The support apparatus of claim 1 further including clamp means.

3. The support apparatus of claim 2 wherein said clamp means comprises at least two C-clamps engageable to said side walls.

4. The support apparatus of claim 3 wherein said C-clamps are tethered to said plate.

5. The support apparatus of claim 1 further including handle means secured to said plate to accommodate manually lifting said apparatus.

6. The support apparatus of claim 5 further including hanger means on said plate for supporting said C-clamps in a non-use position.

7. The support apparatus of claim 1 wherein said adaptor extends transversely across said plate and has a depending leg engageable against one of said side walls in a secured position.

8. The support apparatus of claim 1 wherein said resilient means comprises at least one spring.

9. The support apparatus of claim 1 wherein said support means includes a tube having an upper end which supports a traffic control sign.

10. The support apparatus of claim 1 wherein said adaptor extends transversely across said plate and has an end projecting outward of one of said side walls when in a secured position.

11. The support apparatus of claim 10 further including leg means on said end of said adaptor to engage a side wall of the abutment.

12. The support apparatus of claim 11 wherein said leg means are vertically adjustable.

13. The support apparatus of claim 11 including weight means attached to said adaptor to stabilize the support.

14. A support apparatus securable to a highway abutment of the type having a generally planar top and opposite side walls, said support apparatus comprising:

(a) an elongated base plate having a top and a bottom surface and opposite first and second edges and opposite first and second ends;

(b) fasteners extending from said top surface adjacent said first and second ends;

(c) a first flange depending from said first edge of said base plate for engaging one of said side walls;

(d) slider means having a body with a slot engageable with said fasteners, said slider means having a second flange depending at the second edge of said base plate, said slider means being transversely adjustable for securing said base plate to said abutment with said first and second flanges oppositely engaging said side walls;

(e) receiver means on the top surface of said base plate at an intermediate location;

(f) an adaptor detachably securable at said receiver means having support means thereon; and (g) said support means on said adaptor including an upstanding tube for supporting a sign at its upper end and resilient means for resisting applied forces.

* * * * *